United States Patent [19]

Labbè

[11] 4,223,685

[45] Sep. 23, 1980

[54] CIGARETTE MAKING MACHINE HOPPER

[75] Inventor: Francis A. M. Labbè, Neuilly-sur-Seine, France

[73] Assignee: Molins Limited, London, England

[21] Appl. No.: 18,007

[22] Filed: Mar. 7, 1979

[30] Foreign Application Priority Data

Mar. 18, 1978 [GB] United Kingdom ..... 10800/78

[51] Int. Cl.[3] ..... A24C 1/02

[52] U.S. Cl. ..... 131/109 R

[58] Field of Search ..... 131/109, 109 B, 108, 131/110, 84 R, 110, 20 R, 21 D

[56] References Cited

U.S. PATENT DOCUMENTS

| | | | |
|---|---|---|---|
| 2,326,793 | 8/1943 | Molins et al. | 131/109 R |
| 2,488,844 | 11/1949 | Arelt | 131/109 R |
| 2,989,055 | 6/1961 | Labbe | 131/109 R |
| 4,121,596 | 10/1978 | Labbe et al. | 131/109 B |

*Primary Examiner*—Stephen C. Pellegrino

*Attorney, Agent, or Firm*—John C. Smith, Jr.

[57] ABSTRACT

A hopper for a cigarette making machine includes a tobacco feeding device which delivers tobacco into a downwardly extending channel in which a column of tobacco is formed, and means for feeding tobacco continuously from the lower end of the channel, characterised in that the tobacco feeding device includes means for feeding tobacco onto a conveyor which carries the tobacco to a position at which it drops off the conveyor and enters the upper end of the channel, a spiked conveyor which is spaced slightly from the first conveyor and is arranged to pick up any lumps of tobacco of significant size from the firt conveyor, and means for opening up the lumps of tobacco and for returning the opened up tobacco into the main stream of tobacco.

9 Claims, 2 Drawing Figures

CIGARETTE MAKING MACHINE HOPPER

This invention is concerned with hoppers for cigarette making machines. It is concerned in particular with a hopper of the type in which tobacco is fed into a relatively narrow downwardly extending channel in which a column of tobacco is formed. Tobacco is fed continuously from the lower end of the channel and towards a part of the machine in which the tobacco is formed into a cigarette filler stream.

Out British Pat. No. 1,513,156 and our British patent application No. 22902/76 (and corresponding published German application No. 27 24 596) describe arrangements whereby lumps in the tobacco are picked up by a spiked conveyor before entry into the channel, and are then opened up before being fed back into the remainder of the tobacco. Those arrangements involve the use of a ramp down which the tobacco is arranged to slide, the spiked conveyor being mounted close to the ramp.

The present invention is concerned with a different arrangement for extracting lumps of tobacco. This arrangement can be used in circumstances in which it may not be possible or convenient to use a ramp as described in our above-mentioned earlier specifications. Furthermore, one possible arrangement according to the present invention enables tobacco shorts (i.e. small particles of tobacco) to be extracted from the tobacco in a novel manner; after being extracted, the shorts flow can be smoothed and then fed back into the remainder of tobacco in a known manner.

According to the present invention, a hopper for a cigarette making machine includes a tobacco feeding device which delivers tobacco into a downwardly extending channel in which a column of tobacco is formed, and means for feeding tobacco continuously from the lower end of the channel, characterised in that the tobacco feeding device includes means for feeding tobacco onto a conveyor which carries the tobacco to a position at which the tobacco drops off the conveyor and enters the upper end of the channel, and including a spiked conveyor which is spaced slightly from the first conveyor and is arranged to pick up any lumps of tobacco of significant size from the first conveyor (i.e. especially lumps large enough to jam in the channel), and means for opening up the lumps of tobacco and for returning the opened up tobacco into the main stream of tobacco.

The first conveyor is preferably in the form of a spiked drum. In order to allow for shorts extraction, the following arrangement may be used. The tobacco is fed onto the spiked drum on its upwardly moving side, adjacent to which there is a perforated wall through which shorts can pass while longer tobacco is carried upwards by the drum.

Examples of hoppers according to this invention are shown in the accompanying drawings. In these drawings.

Figure 1:
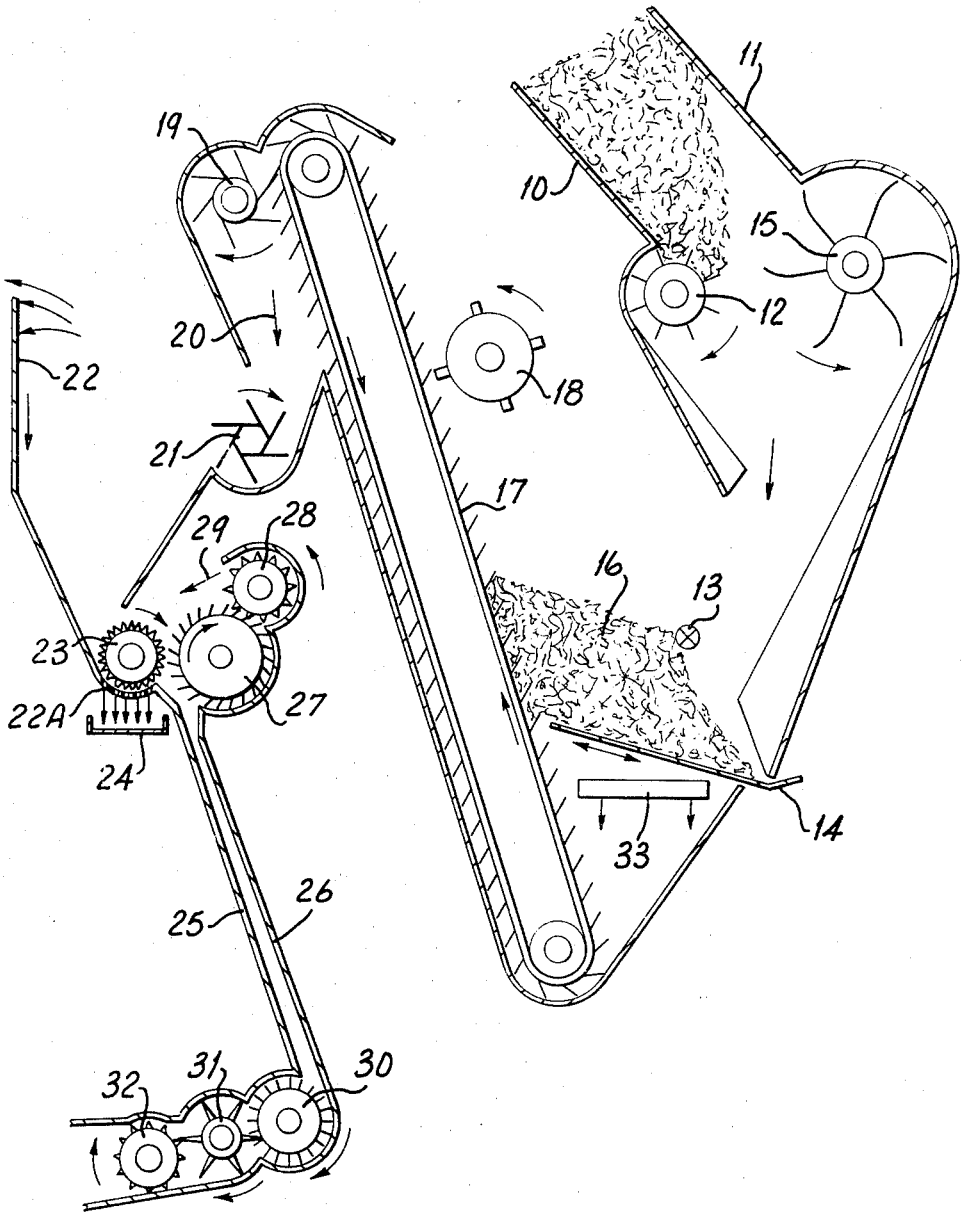
FIG. 1 is a diagrammatic sectional view of one hopper.

FIG. 1 shows a hopper in which tobacco is received initially in a wide sloping channel formed by parallel walls 10 and 11. A feed roller 12 at the lower end of the channel 10, 11 holds up the tobacco so long as it is not rotating. Whenever a horizontal beam of light strikes a photo-cell 13 so as to indicate that more tobacco needs to be delivered onto a reciprocating tray 14, the roller 12 is driven so as to feed tobacco from the channel 10, 11 downwards onto the tray 14. An additional feed roller 15 is included if the hopper is required for tobacco having relatively long strands; the roller 15 may rotate continuously or may be driven selectively in unison with roller 12.

The arrangement so far described is similar to certain of the arrangements described in our British patent application No. 22902/76 (and in corresponding German Offenlegungsschrift No. 2,724,596), to which reference is directed.

A thick carpet of tobacco 16 is fed by the tray 14 towards a spiked elevator band 17. Any lumps of tobacco protruding from the spikes of the elevator band are removed by a roller 18, and the remainder of the tobacco which continues upwards on the elevator is removed by an unravelling roller 19. An arrow 20 shows approximately the direction in which tobacco is projected downwards by the roller 19.

The tobacco is then projected by a projector roller 21 towards a wall 22. Any heavy foreign bodies in the tobacco pass over the top edge of the wall 22, where they may be received by a receptacle (not shown) while tobacco strikes the wall 22 and then slides down it onto a first spiked drum 23.

In the region where the tobacco lands on the drum 23, the periphery of the drum moves in a generally upward direction. Most of the tobacco is carried upwards by the drum 23, but tobacco shorts can filter downwards between the drum 23 and a lower end portion of the wall 22. An extension of the lower end of the wall 22 is in the form of a part-cylindrical portion 22A which is perforated to allow tobacco shorts to drop through it onto a vibratory tray conveyor 24.

Loose tobacco which is carried initially upwards by the drum 23 falls from the right-hand side of the drum 23 and passes directly into a channel formed by slightly diverging walls 25 and 26. On the other hand, any lumps of tobacco of significant size are picked up by a second spiked drum 27 which carries the lumps upwards to a position at which a picker roller 28 removes the lumps with a vigorous action tending to open up the lumps, and projects the opened up tobacco in the direction of the arrow 29 so that it lands back on top of the spiked drum 23. Any significant lumps which survive this opening up operation can again be picked up by the spiked drum 27 to be subjected to a repeat of the opening up operation.

It should be noted that the spikes or pins on the drum 23 are radial and are conical in shape so as to allow loose tobacco to drop readily from the drum and into the channel 25, 26; the speed of the drum 23 is preferably such as to produce a centrifugal force on the tobacco (e.g. of about $\frac{1}{3}$ g) sufficient to ensure that the tobacco does drop into the channel, but not sufficient to transfer the tobacco onto the drum 27. The drum 27 has thin inclined spikes (as shown) so as to facilitate picking up of protruding lumps of tobacco and their subsequent removal by the picker roller 28. The tips of the spikes on the drum 27 are slightly clear of the tips of the spikes on the drum 23, so that the drum 27 only picks up lumps which project significantly from the spikes of the drum 23. More specifically, imaginary cylindrical surfaces containing respectively the tips of the spikes of drums 23 and 27 may be spaced apart by a distance of up to approximately 6 mm.

The pins of the picker roller 28 intercalate with the spikes on the drum 27.

By way of example, the speeds of the rollers 23, 27 and 28 may be as follows. The roller 23 rotates at about 70 R.P.M.; roller 27 rotates at about 120 R.P.M.; and roller 28 rotates at about 400 R.P.M. to 800 R.P.M. (the speed in this case possibly being adjustable).

Tobacco is fed continuously from the lower end of the channel 25, 26 by a spiked drum 30, picker roller 31 and projector roller 32, e.g. in the manner described in one of the above-mentioned specifications.

As described in our British patent application No. 22902/76, tobacco removed from the cigarette filler stream (i.e. "discard" tobacco) may be returned to the hopper by a vibrating tray 33 below the reciprocating tray 14.

In place of the elevator 17, unravelling roller 19 and projector roller 21, the tobacco may be delivered onto the spiked drum 23 in the manner described with reference to FIG. 5 of our British Pat. No. 1,456,498. The tobacco shorts collected on the tray 24 may also be conveyed and distributed in the manner described in British Pat. No. 1,456,498.

Figure 2:
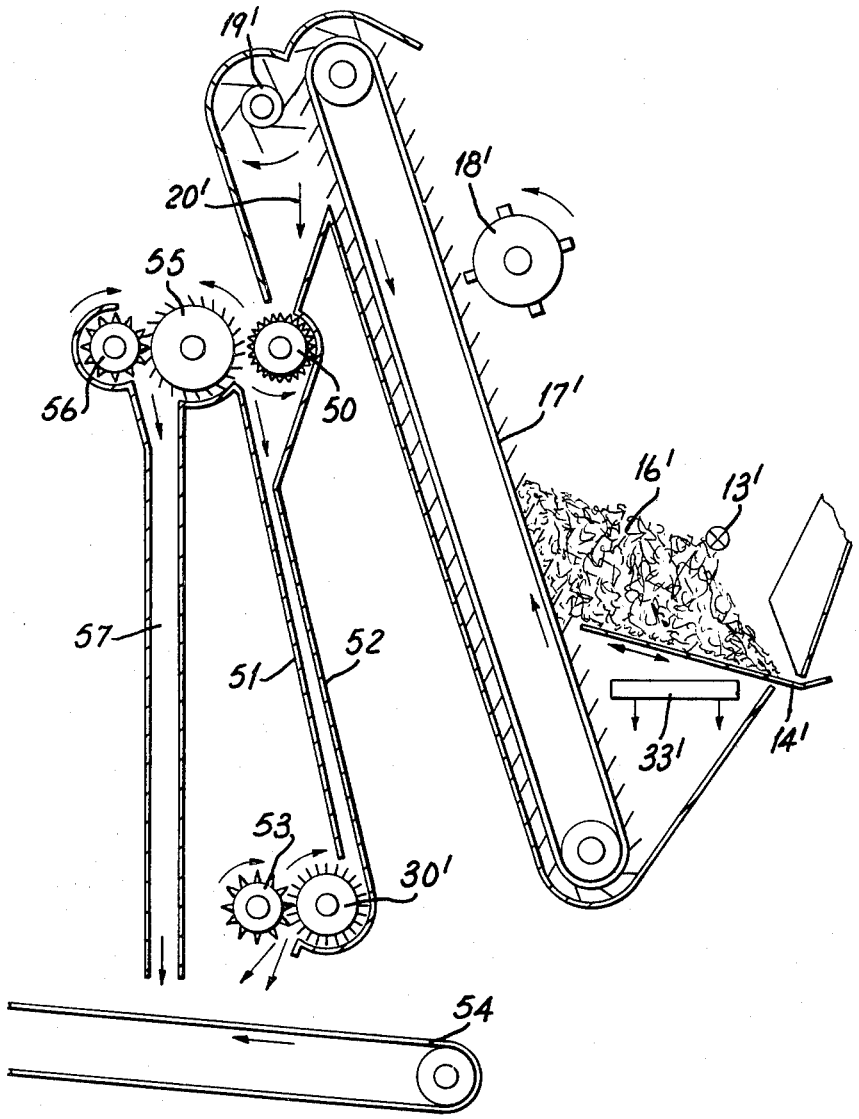
FIG. 2 is a diagrammatic sectional view of part of a different hopper.

FIG. 2 shows a different hopper which is partly similar to the hopper shown in FIG. 1, as indicated by the use of the same reference numerals in primed form.

In FIG. 2 the tobacco removed from the elevator 17' fall directly onto a spiked drum 50 which corresponds to the drum 23 in FIG. 1. Loose tobacco is carried to the left by the drum 50 and then drops off into a channel formed by downwardly extending walls 51 and 52. Tobacco is fed from the lower end of the channel 51, 52 by a spiked drum 30', but in this example the tobacco is removed from the drum 30' by a picker roller 53 which projects the tobacco downwards onto a conveyor band 54 arranged to carry a thin carpet of tobacco towards a device (not shown) for forming a cigarette filler stream in any conventional manner.

Lumps of tobacco of significant size are picked up from the drum 50 by a spiked drum 55 corresponding to the drum 27 in FIG. 1. A picker roller 56 then removes the lumps from the drum 55 with a vigorous action which opens up the lumps. This opened up tobacco then passes downwards through a chute 57 and onto the conveyor band 54.

Another possible alternative is as follows. The picker roller 28 in FIG. 1 may be arranged to project the opened up tobacco to the lower end of the downwardly moving run of the elevator 17, somewhat in the manner shown in FIG. 1 of our British patent application No. 22902/76.

I claim:

1. A hopper for a cigarette making machine including a tobacco feeding device which delivers tobacco into a downwardly extending channel in which a column of tobacco is formed, and means for feeding tobacco continuously from the lower end of the channel, characterized in that the tobacco feeding device includes means for feeding a stream of tobacco onto a first conveyor which carries the stream of tobacco to a position at which it drops off the conveyor and enters the upper end of the channel, said first conveyor, channel and means for feeding tobacco from the lower end of the channel being arranged along a main path, a spiked conveyor which is spaced slightly from the first conveyor and is arranged to selectively pick up any lumps of tobacco of significant size from the stream of tobacco on the first conveyor, and means for opening up the lumps of tobacco and for returning the opened up tobacco into the main path of the tobacco, said spiked conveyor and means for opening up the lumps of tobacco and for returning the opened up tobacco being along a second path.

2. A hopper according to claim 1 in which the first conveyor is a spiked drum.

3. A hopper according to claim 2, including a perforated wall adjacent to the spiked drum, the tobacco feeding device being arranged to deliver the tobacco onto the upwardly moving side of the spiked drum, whereby tobacco shorts can pass downwards and through the perforated plate.

4. A hopper according to claim 2 or claim 3, in which the spiked conveyor comprises a spiked drum, and in which the means for opening up the lumps of tobacco comprises a picker roller which is adapted to rotate at a sufficient speed to remove the lumps from the spiked drum with a vigorous action.

5. A hopper according to claim 4, in which the picker roller is arranged to return the opened up tobacco onto the first conveyor.

6. A hopper according to claim 4, in which the picker roller is arranged to feed the opened up tobacco directly onto a conveyor which receives the tobacco from the lower end of the channel.

7. In a hopper for a cigarette making machine:

(a) means for directing tobacco along a main path and means for directing selected of said tobacco along a second path extending between spaced locations along said main path;

(b) said means for directing tobacco along a main path comprising:

1. means defining a downwardly extending channel for forming a column of tobacco,
2. first conveyor means for feeding a stream of tobacco into the upper end of said channel, and
3. means for feeding tobacco continuously from the lower end of said channel; and (c) said means for directing selected of said tobacco along said second path comprising:

1. a spiked conveyor adjacent said first conveyor means, the distance between said spiked conveyor and said first conveyor means being such that said spiked conveyor selectively picks up any lumps of tobacco of sufficient size from said stream of tobacco on said first conveyor, and
2. means for opening up said lumps of tobacco and for returning the opened up tobacco to said main path;

(d) whereby jamming of said channel by lumps of tobacco is avoided and the tobacco dispensed from said hopper is free of lumps of significant size.

8. A hopper according to claim 7 wherein said spiked conveyor is arranged to selectively pick up any lumps of tobacco of significant size from said stream of tobacco at a first position along said main path and said means for opening up said lumps of tobacco and for returning the opened up tobacco to said main path is arranged to return said opened up tobacco at a second position along said main path upstream of said first position along said main path.

9. A hopper according to claim 7 wherein said spiked conveyor is arranged to selectively pick up any lumps of tobacco of significant size from said stream of tobacco at a first position along said main path and said means for opening up said lumps of tobacco and for returning the opened up tobacco to said main path is arranged to return said opened up tobacco at a second position along said main path downstream of said first position along said main path.

* * * * *